US008245515B2

(12) United States Patent
Davis, Jr. et al.

(10) Patent No.: US 8,245,515 B2
(45) Date of Patent: Aug. 21, 2012

(54) TRANSITION DUCT AFT END FRAME COOLING AND RELATED METHOD

(75) Inventors: Lewis B. Davis, Jr., Niskayuna, NY (US); Ronald J. Chila, Greer, SC (US); Kevin W. McMahan, Greer, SC (US)

(73) Assignee: General Electric Company, Schenectady, NY (US)

( * ) Notice: Subject to any disclaimer, the term of this patent is extended or adjusted under 35 U.S.C. 154(b) by 781 days.

(21) Appl. No.: 12/222,298

(22) Filed: Aug. 6, 2008

(65) Prior Publication Data

US 2010/0034643 A1 Feb. 11, 2010

(51) Int. Cl.
*F02C 1/00* (2006.01)

(52) U.S. Cl. ..... 60/752; 415/144

(58) Field of Classification Search ..... 60/752; 415/144

See application file for complete search history.

(56) References Cited

U.S. PATENT DOCUMENTS

| | | | | |
|---|---|---|---|---|
| 4,652,284 | A * | 3/1987 | Misko | 96/193 |
| 5,414,999 | A * | 5/1995 | Barnes | 60/722 |
| 5,724,284 | A * | 3/1998 | Bill et al. | 365/185.2 |
| 5,724,816 | A | 3/1998 | Ritter et al. | |
| 6,761,031 | B2 * | 7/2004 | Bunker | 60/752 |
| 6,769,257 | B2 * | 8/2004 | Kondo et al. | 60/730 |
| 6,834,507 | B2 * | 12/2004 | Jorgensen | 60/800 |
| 2003/0106317 | A1 * | 6/2003 | Jorgensen et al. | 60/722 |

* cited by examiner

*Primary Examiner* — Julio J Maldonado
*Assistant Examiner* — Robert Bachner
(74) *Attorney, Agent, or Firm* — Nixon & Vanderhye, P.C.

(57) ABSTRACT

A transition duct for a gas turbine includes a tubular body having a forward end and an aft end, the aft end surrounded by a frame component; an interior closure band within the aft end, covering interior top, bottom and side wall surfaces of the frame; and a plurality of cooling channels between the frame and the closure band, each having an inlet and an outlet at the forward and aft ends, respectively.

12 Claims, 4 Drawing Sheets

TRANSITION DUCT AFT END FRAME COOLING AND RELATED METHOD

This invention relates to gas turbine combustor technology generally, and to an apparatus and related method for cooling the aft end frame of a transition piece or duct that extends between a combustor and the first stage of the turbine.

BACKGROUND OF THE INVENTION

Typically, transition ducts have an aft frame which is attached, or integrated into, the aft end of the duct, facilitating attachment of the duct to the inlet of the turbine first stage. The aft frame is often cooled by means of controlled seal leakage and/or small cooling holes that allow compressor discharge air to pass through the frame. See for example, U.S. Pat. Nos. 6,769,257; 5,414,999; 5,724,816; and 4,652,284. Nevertheless, excessively high temperatures and thermal gradients may be experienced in the vicinity of the transition duct aft end frame. Accordingly, there remains a need for more effective cooling techniques in these areas.

BRIEF DESCRIPTION OF THE INVENTION

In one aspect, the present invention relates to a transition duct for a gas turbine comprising: a tubular body having a forward end and an aft end, the aft end surrounded by a frame component; an interior closure band within the frame covering interior top, bottom and side wall surfaces of the frame; and a plurality of cooling channels between the frame and the closure band, each having an inlet and an outlet at the forward and aft ends, respectively.

In another aspect, the invention relates to a method of providing cooling air to an aft end frame of a gas turbine transition duct comprising: forming plural cooling channels between an interior surface of the aft frame and an exterior surface of a closure band located within the aft frame, and attaching the aft frame and the closure band to an aft edge of the transition duct.

The invention will now be described in greater detail in connection with the drawings identified below.

DETAILED DESCRIPTION OF THE INVENTION

Figure 1:
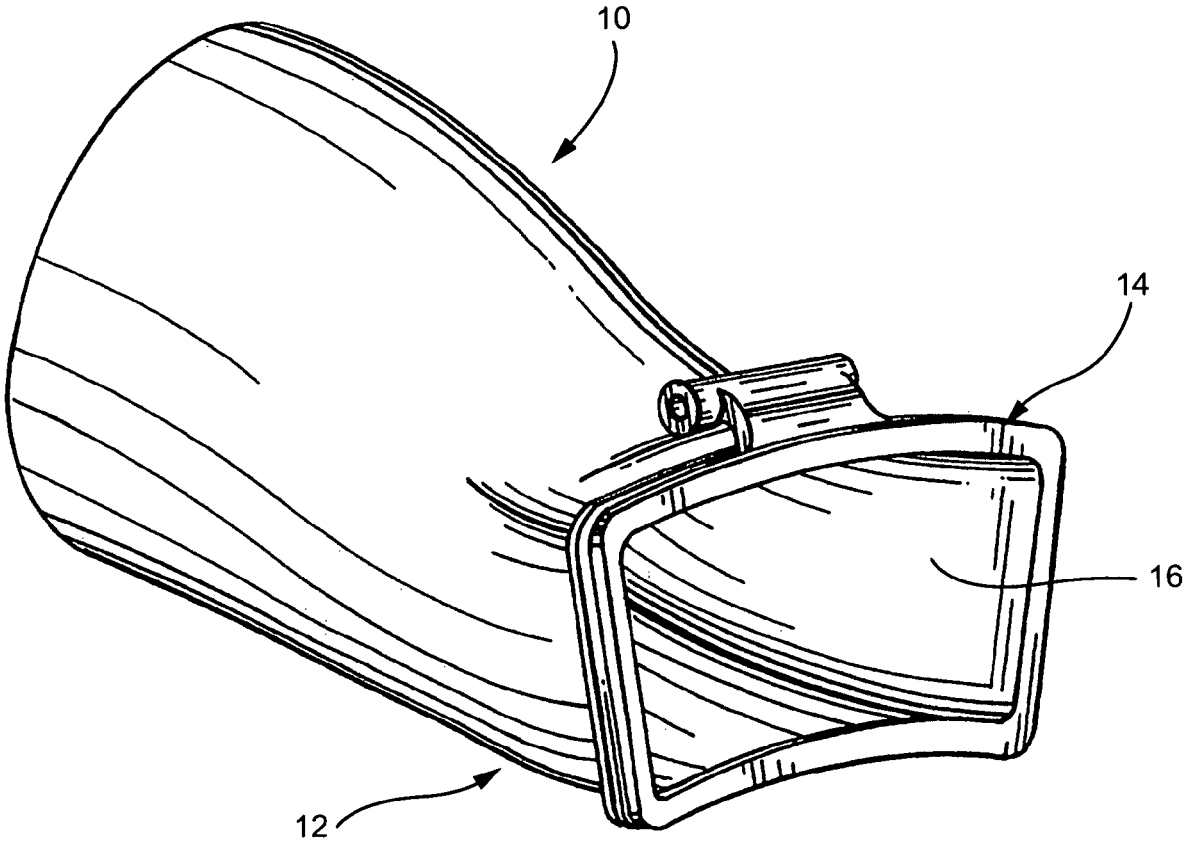
FIG. 1 is a partial aft end perspective view of a conventional turbine transition piece fitted with an aft end frame.
Figure 2:
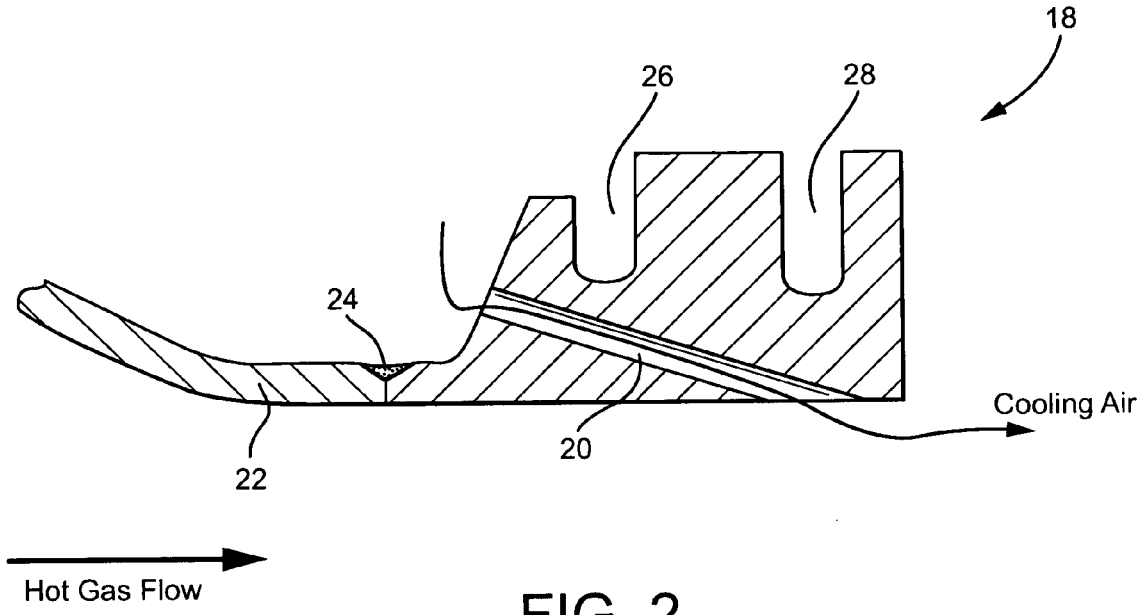
FIG. 2 (Prior Art)
FIG. 2 is a partial cross section through a conventional transition piece aft end frame, illustrating cooling holes drilled through the frame.

In a typical can-annular combustor configuration in a gas turbine, an array of combustors surrounding the turbine rotor supply hot combustion gases to the turbine first stage via a corresponding array of transition ducts that extend between the combustors and the first stage inlets. With reference to FIG. 1, one such transition piece or duct 10 connects at a forward end to a combustor liner (not shown). The aft end 12 of the transition duct in the exemplary embodiment has an integral or attached aft end frame 14 surrounding the outlet 16, thus facilitating attachment to the turbine first stage nozzle (not shown). FIG. 2 illustrates another known transition piece aft end frame 18 formed with plural cooling holes 20 drilled or otherwise formed in the frame. The frame 18 is welded to the transition duct at 24. Seal cavities 26, 28 are typically provided in the aft frame for receiving seals at the transition duct-turbine nozzle interface.

Figure 3:
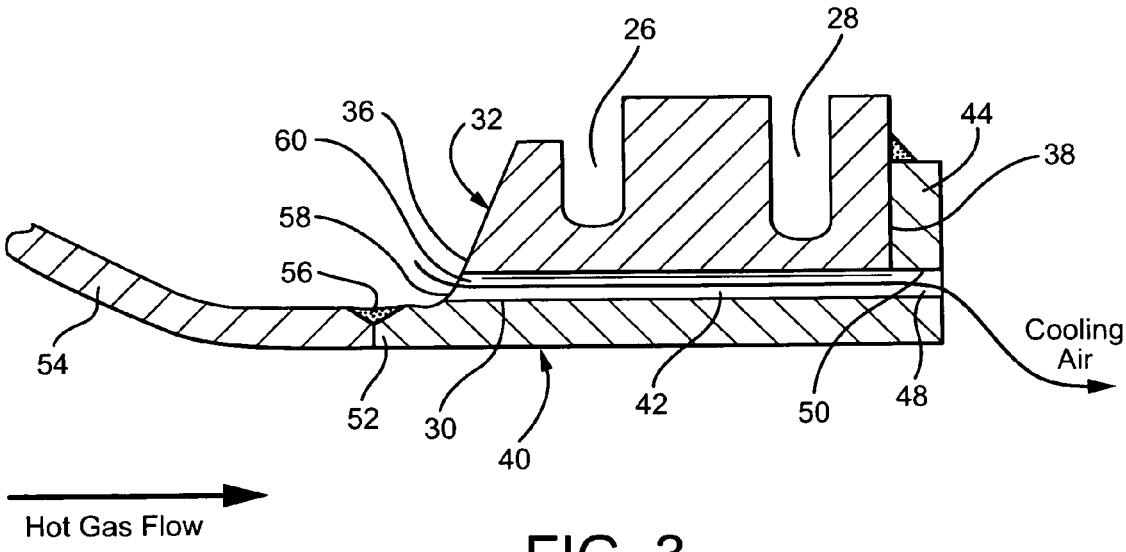
FIG. 3 is a partial cross section similar to FIG. 2 but illustrating a transition piece aft end frame in accordance with an exemplary but nonlimiting embodiment of the invention.
Figure 4:
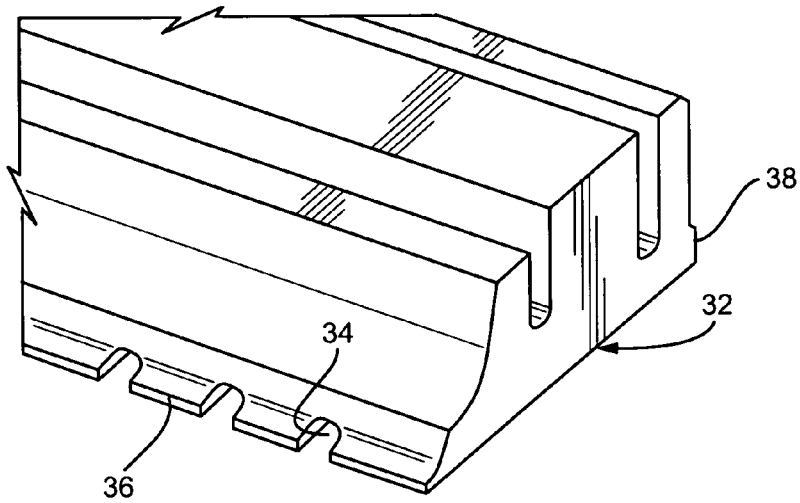
FIGS. 4 and 5 are partial perspective views of a transition piece aft end frame similar to that shown in FIG. 3, but with a cooling channel cover band omitted.
Figure 5:
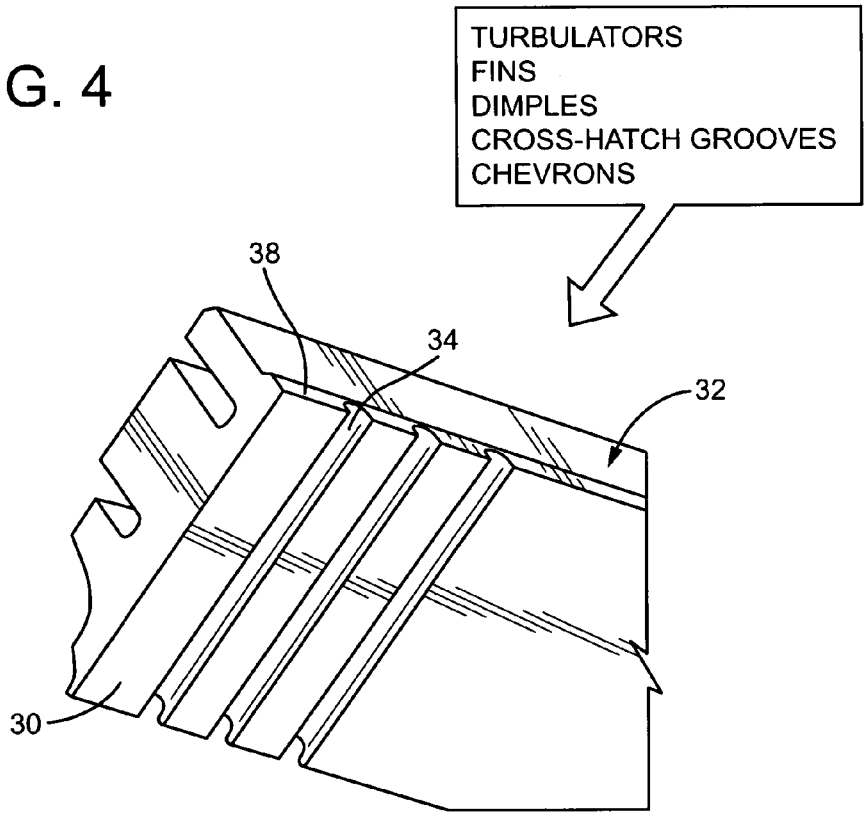

Referring now to FIGS. 3-5, in one exemplary but nonlimiting embodiment of this invention, an inner surface 30 of the frame 32 is worked (by milling, casting, laser etching, etc.) to create a plurality of axially-oriented, three-sided, open cooling channels 34 extending from the forward edge 36 of the frame to the rearward or aft edge or face 38.

The cooling channels 34 may be provided on one, all or any combination of the interior top, side and bottom surfaces (generally referred to as the inner surface 30) of the aft frame, and the number of channels or grooves 34 in each of those surfaces may also vary as desired. The channels 34 may be of any suitable cross-sectional shape including rectangular as shown in FIGS. 4-5, but also including semi-circular, oval, V-shaped etc. In addition, the cross-sectional areas of the various channels in any single frame may be substantially uniform or may vary in any fashion.

In this first exemplary embodiment, the three-sided channels 34 are substantially closed by a metal wrapper or closure band 40 (FIG. 3) that forms the inner wall of the channels 34 thus forming closed-periphery passageways 42. Note that the closure band 40 is exposed to the flow of hot gases through the transition piece. The closure band 40 has an aft outwardly extending flange 44 (the closure band 40 may therefore also be regarded as an "L-bracket")that engages and is welded or otherwise fixed to the aft edge or face 38 of the frame. Holes or apertures 48 are drilled or otherwise formed in the flange 44 to align with the channels 34 thus providing outlets 50 for the passageways 42. The forward end 52 of the band 40 extends beyond (i.e., upstream of) the forward edge 36 of the frame, and is welded to the transition piece 54 at 56. The sloped edge 58 of the frame provides enlarged inlets 60 to the passageways 42.

Figure 6:
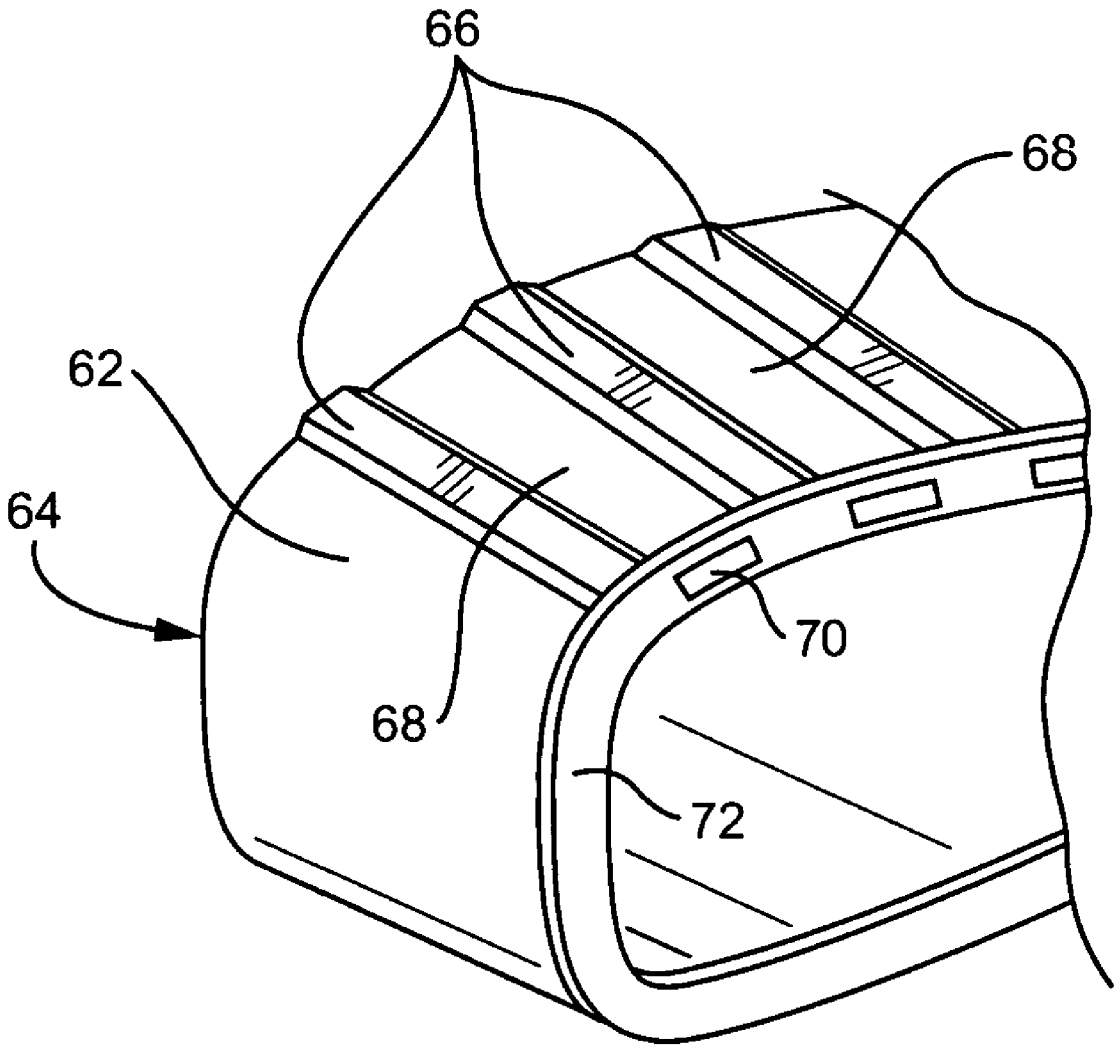
FIG. 6 is a partial perspective view of an aft end frame closure band in accordance with another exemplary embodiment of the invention.

In another exemplary but nonlimiting embodiment, the cooling channels may be formed by a series of raised ribs which are either integrally formed on, or fastened by any suitable means to the outer surface of the L-bracket such that the channels are closed by the smooth interior frame surface, forming the outer wall of the channels. This arrangement is shown in FIG. 6 where the exterior surface 62 of the closure band 64 is provided with a plurality of substantially axially-extending ribs 66, integrally or by attachment, thus forming a plurality of three-sided, open channels 68. The fourth or open side of the channels is closed by the smooth interior surface of the aft frame, thus forming cooling passageways similar to passageways 42 in FIGS. 3-5. As in the earlier-described embodiment, apertures or holes 70 are required to be formed in the vertical stem or flange 72 of the closure band to form the outlets of the passageways. As in the earlier described embodiment, any number of ribs 66 may be formed on any one or all of the top, bottom and side surfaces of the frame.

One or more of the bounding walls of the cooling passageways themselves may also be formed or provided with any of several known heat transfer enhancement mechanisms, such as, for example, turbulators, fins, dimples, cross-hatch grooves, chevrons or any combination thereof (see FIG. 5).

The arrangement and number of such enhancements may be varied as desired among the various channels.

Cooling air may be delivered to the passageways 42 in any number of ways. For example, the passageways may be exposed at their upstream ends (i.e., at their respective inlets) to compressor discharge flow, or they may be fed directly from a separate inlet or manifold. The cooling flow may exit into the hot gas flow from any multiple of outlets in the closure band or L-bracket.

Note that the above-described aft end cooling arrangement can be used with or without conventional impingement cooling sleeves that are used to impingement cool areas of the duct upstream of the aft end.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A transition duct for a gas turbine comprising:

a tubular body having a forward end and an aft end;

a discrete closure band attached to said aft end of said tubular body, said discrete closure band surrounded by a frame such that said closure band covers a radially inner periphery of said frame; said closure band having a radially outwardly directed flange extending about said closure band and at least partially covering an aft end face of said frame; and a plurality of cooling channels formed radially between said frame and said closure band, and extending axially along said frame and through said radially outwardly directed flange.

2. The transition duct of claim 1 wherein said plurality of cooling channels are formed in at least one of interior top, bottom and side wall surfaces of said frame.

3. The transition duct of claim 1 wherein said plurality of cooling channels have substantially rectangular cross-sectional shapes.

4. The transition duct of claim 1 wherein said plurality of cooling channels are provided with heat transfer enhancement devices selected from a group comprising turbulators, fins, dimples, cross-hatch grooves and chevrons for enhancing heat transfer.

5. The transition duct of claim 1 wherein one or more of said plurality of cooling channels are provided on each of said top, bottom and side walls of said frame.

6. The transition duct of claim 1 wherein said plurality of cooling channels are formed by plural ribs provided on one or more exterior top, bottom and side wall surfaces of said closure band, one wall of each of said plurality of cooling channels being formed by an interior wall surface of said frame.

7. A method of providing cooling air to an aft frame of a gas turbine transition duct comprising:

locating a discrete closure band radially inward of within said aft frame, said closure band formed with an annular radially-outwardly extending flange at one end that at least partially covers an aft end face of said frame;

forming plural cooling channels in said aft frame, radially between a radially inner surface of said aft frame and a radially outer surface of said closure band and extending through said annular, radially-outwardly extending flange; and attaching an opposite end of said closure band to an aft edge of said transition duct.

8. The method of claim 7 including forming three-sided open grooves in an interior surface of said aft frame, and closing a fourth side with said closure band.

9. The method of claim 7 including providing said exterior surface of said closure band with a plurality of ribs to form three-sided channels, and closing a fourth side of said channels with said interior surface of said aft frame.

10. The method of claim 8 wherein said three-sided open grooves are formed on top, bottom and side surfaces of said aft frame.

11. The method of claim 7 including forming said plural open cooling channels with heat transfer enhancement devices selected from a group comprising turbulators, fins, dimples, cross-hatch grooves and chevrons.

12. The method of claim 7 including providing said plural cooling channels in an array surrounding said outlet of said transition duct.

* * * * *

UNITED STATES PATENT AND TRADEMARK OFFICE

CERTIFICATE OF CORRECTION

PATENT NO. : 8,245,515 B2
APPLICATION NO. : 12/222298
DATED : August 21, 2012
INVENTOR(S) : Davis, Jr. et al.

It is certified that error appears in the above-identified patent and that said Letters Patent is hereby corrected as shown below:

Claim 7, column 4, line 15, delete "within" after --radially inward of--

Signed and Sealed this
Eleventh Day of December, 2012

David J. Kappos

David J. Kappos
*Director of the United States Patent and Trademark Office*